US009332605B2

(12) United States Patent
Nederbragt et al.

(10) Patent No.: US 9,332,605 B2
(45) Date of Patent: May 3, 2016

(54) LIGHTING SYSTEM

(71) Applicant: Texas Instruments Incorporated, Dallas, TX (US)

(72) Inventors: Irwin Rudolph Nederbragt, Brighton, CO (US); Steven Michael Barrow, Longmont, CO (US); Yan Yin, Longmont, CO (US); Craig Steven Cambier, Louisville, CO (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 213 days.

(21) Appl. No.: 14/100,382

(22) Filed: Dec. 9, 2013

(65) Prior Publication Data

US 2014/0361691 A1 Dec. 11, 2014

Related U.S. Application Data

(60) Provisional application No. 61/832,640, filed on Jun. 7, 2013.

(51) Int. Cl.
*H05B 37/00* (2006.01)
*H05B 41/00* (2006.01)
*H05B 33/08* (2006.01)

(52) U.S. Cl.
CPC ..... *H05B 33/083* (2013.01)

(58) Field of Classification Search
USPC ..... 315/119–128
See application file for complete search history.

(56) References Cited

U.S. PATENT DOCUMENTS

| | | | | |
|---|---|---|---|---|
| 7,800,316 | B2 | 9/2010 | Haug | |
| 8,188,679 | B2 | 5/2012 | Hoogzaad | |
| 8,203,283 | B2 * | 6/2012 | Hoogzaad | 315/291 |
| 8,237,372 | B2 * | 8/2012 | Hoogzaad et al. | 315/291 |
| 2004/0090403 | A1 | 5/2004 | Huang | |
| 2006/0261754 | A1 * | 11/2006 | Lee | 315/291 |
| 2010/0052569 | A1 * | 3/2010 | Hoogzaad et al. | 315/294 |
| 2010/0194274 | A1 | 8/2010 | Hoogzaad | |
| 2010/0225251 | A1 | 9/2010 | Maruyama | |
| 2011/0109247 | A1 * | 5/2011 | Hoogzaad | H05B 33/0818 315/294 |
| 2014/0042925 | A1 * | 2/2014 | Wang | 315/232 |

FOREIGN PATENT DOCUMENTS

WO WO2013021320 A1 2/2013

OTHER PUBLICATIONS

PCT/US14/41587 Search Report mailed Sep. 30, 2014.

* cited by examiner

*Primary Examiner* — Brandon S Cole
(74) *Attorney, Agent, or Firm* — William B. Kempler; Frank D. Cimino

(57) ABSTRACT

A lighting system includes a switch configured so that when the switch is in a first state, current from a supply flows to a light emitter, and when the switch is in a second state, current from the supply flows through the switch bypassing the light emitter. A capacitor in parallel with the light emitter provides current to the light emitter sufficient to cause the light emitter to emit light when the switch is in the second state.

10 Claims, 4 Drawing Sheets

LIGHTING SYSTEM

This application claims the benefit of U.S. Provisional Application No. 61/832,640 filed Jun. 7, 2013, which is hereby incorporated by reference.

BACKGROUND

There is an ongoing demand for efficient (high Lumens per Watt) lighting systems powered directly by an alternating current (AC) power mains (for example, $120V_{RMS}$, 60 Hz, or $230V_{RMS}$, 50 Hz). Examples include household and commercial indoor lighting, outdoor street lights, traffic lights, signage, etc. One example technology for efficient light emitters is Light Emitting Diodes (LED's).

FIG. 1A illustrates a lighting system 100 in which LED's 102 are connected in series and driven directly by a rectified AC supply voltage $V_{RAC}$. The system may also include a current limiter or current regulator 104.

FIG. 1B illustrates example timing for the lighting system 100. Let $V_T$ be the threshold at which the supply voltage $V_{RAC}$ exceeds the forward-biased voltage of the entire series of LED's 102 plus the voltage drop across the current limiter 104. At time $t_0$, the supply voltage $V_{RAC}$ starts increasing from zero. At time $t_1$, the supply voltage $V_{RAC}$ exceeds the threshold $V_T$ and the LED's 102 emit light. At time $t_2$ the supply voltage $V_{RAC}$ falls below the threshold $V_T$ and the LED's 102 stop emitting light. As a result, the LED's 102 are on only during the time period from $t_1$–$t_2$ (the shaded portion 106 of the supply voltage $V_{RAC}$). Accordingly, light is emitted for only a fraction of the time, and the light flickers at twice the frequency of the AC power mains. If the peak of the supply voltage $V_{RAC}$ drops too far (for example, during a "brown-out", or as a result of a dimming switch) then the lighting system 100 may fail to turn on.

FIG. 2 illustrates an alternative example of a lighting system 200 in which current for LED's is provided by electronic drivers. In the example of FIG. 2, a rectified AC supply voltage $V_{RAC}$ provides power to a plurality of driver/bypass circuits (204, 206, 208, 210) connected in series, and to a current limiter or current regulator 202. Each driver/bypass circuit (204, 206, 208, 210) drives one LED (212, 214, 216, 218). Each driver/bypass circuit (204, 206, 208, 210) includes a bypass switch that can bypass current around its LED. When the supply voltage ($V_{RAC}$) exceeds a voltage sufficient to power LED 212 (and the current limiter or current regulator 202, and accounting for the series voltage drops of the bypass switches), driver/bypass circuit 204 turns on, opens its bypass switch, and drives its LED 212. As the supply voltage ($V_{RAC}$) continues to increase, the driver/bypass circuits (206, 208, 210) sequentially turn on (and open their bypass switches) until all of the LED's are being driven. When the supply voltage ($V_{RAC}$) decreases, the driver/bypass circuits (204, 206, 208, 210) sequentially turn off (and close their bypass switches). As a result, LED's start turning on at a relatively low voltage, and as the supply voltage ($V_{RAC}$) increases, more LED's are driven and the overall intensity increases. As the supply voltage ($V_{RAC}$) decreases, fewer LED's are driven and the overall intensity decreases.

There is an ongoing need for improved lighting systems.

DETAILED DESCRIPTION

Figure 1A:
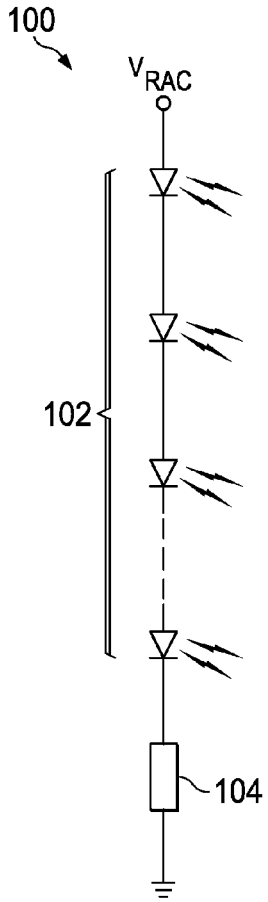
FIG. 1A (PRIOR ART)
FIG. 1A is a block diagram schematic of an example prior art lighting system.
Figure 1B:
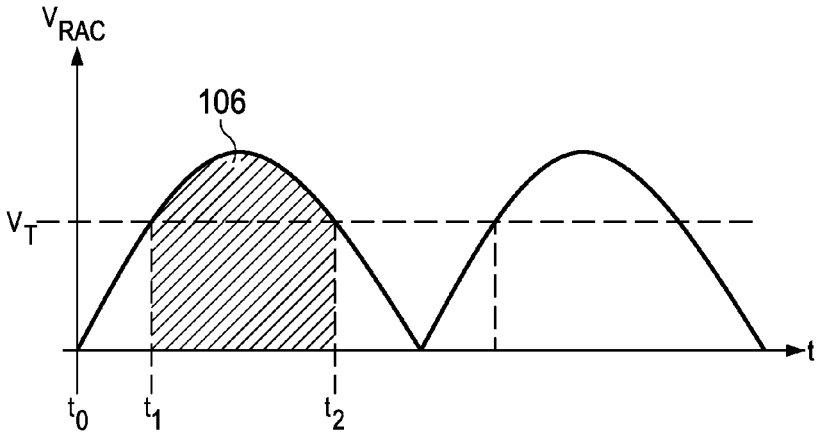
FIG. 1B (PRIOR ART)
FIG. 1B is a timing diagram illustrating example timing for the lighting system of FIG. 1A
Figure 3:
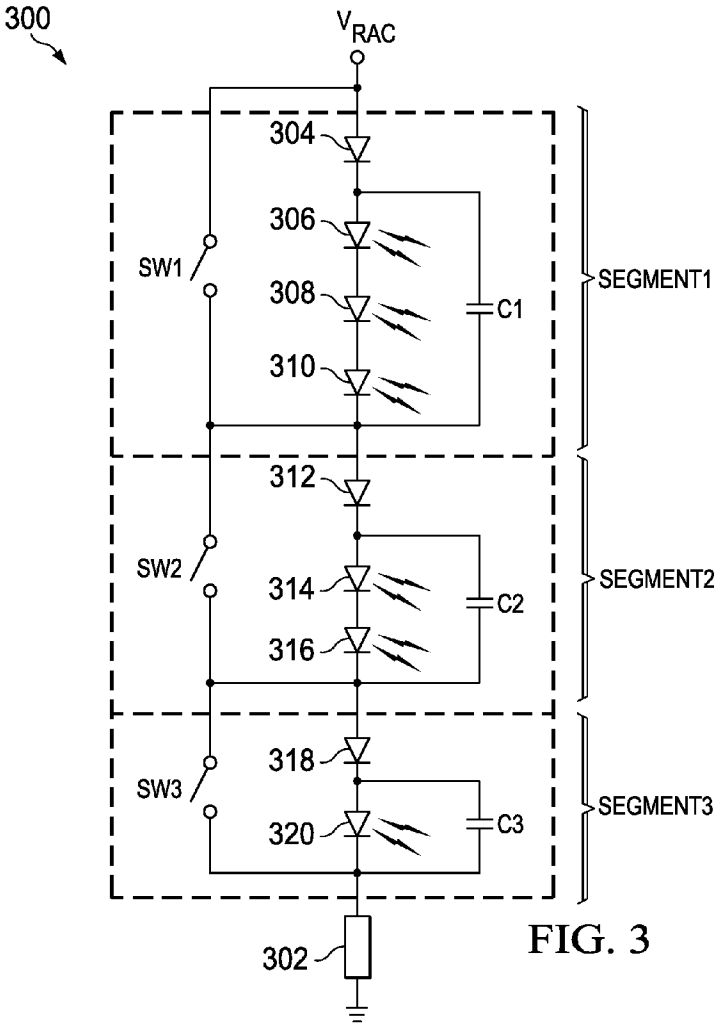
FIG. 3 is a block diagram schematic of an example embodiment of an improved lighting system.
Figure 2:
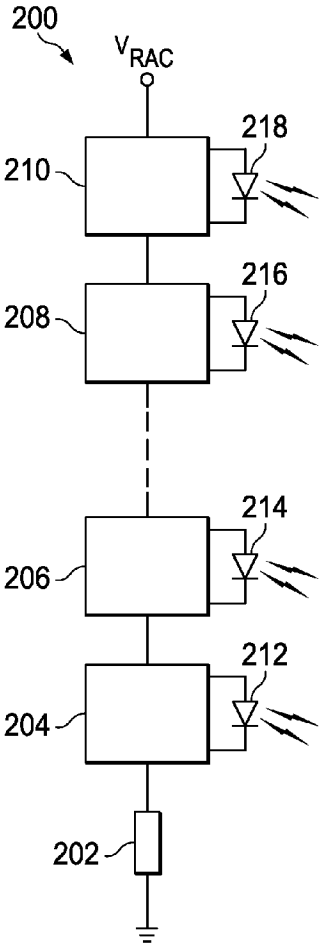
FIG. 2 (PRIOR ART)
FIG. 2 is a block diagram schematic of an example of an alternative prior art lighting system.

FIG. 3 illustrates an example embodiment of an improved lighting system 300. In FIG. 3, light emitters (306, 308, 310, 314, 316, 320) are divided into three segments (SEGMENT1, SEGMENT2, SEGMENT3) and the segments are connected in series. The number of segments and the number of light emitters per segment may vary and FIG. 3 illustrates just one example simplified for illustration. The light emitters (306, 308, 310, 314, 316, 320) may be, for example, LED's, but the lighting system 300 may also be applicable to other efficient low-voltage light emitters. The lighting system 300 is driven by a rectified AC supply voltage $V_{RAC}$. The lighting system 300 includes a current regulator 302. Each segment includes an electronic bypass switch (SW1, SW2, SW3), an isolation diode (304, 312, 318) connected in series with the light emitter(s) within the segment, and a capacitor (C1, C2, C3) connected in parallel with the light emitter(s) within the segment. Each electronic bypass switch (SW1, SW2, SW3) has associated switch control circuitry (not illustrated in FIG. 3), which will be explained in conjunction with FIG. 5.

As will be explained below, there are initial conditions when the supply voltage $V_{RAC}$ is first turned on, and then after an initialization period (possibly a few half-cycles of the supply voltage $V_{RAC}$) there are steady-state conditions. Initially, all bypass switches (SW1, SW2, SW3) are closed and no current flows into the light emitters (306, 308, 310, 314, 316, 320). When the supply voltage $V_{RAC}$ increases above a first threshold, bypass switch SW3 opens, light emitter 320 receives current through bypass switches SW1 and SW2 and isolation diode 318, light emitter 320 emits light, and capacitor C3 charges. Similarly, when the supply voltage $V_{RAC}$ increases above other thresholds, additional segments turn on and off, depending on the available voltage, and additional capacitors (C1, C2) charge. Depending on the size of the capacitors, it may take a few half-cycles of the supply voltage $V_{RAC}$ to fully charge. Once the capacitors are charged, then in the steady-state the capacitors (C1, C2, C3) supply current to the light emitters (306, 308, 310, 314, 316, 320) when the bypass switches (SW1, SW2, SW3) are closed so that the light emitters emit light continuously. The isolation diodes (304, 312, 318) prevent the capacitors from discharging through the bypass switches.

When the supply voltage $V_{RAC}$ increases above a second threshold, bypass switch SW2 opens, light emitters 314 and 316 receive current through bypass switch SW1 and isolation diode 312, light emitters 314 and 316 emit light, and capacitor C2 charges. As bypass switch SW2 opens, the voltage at the anode of isolation diode 312 in SEGMENT2 is close to the supply voltage $V_{RAC}$, and the voltage at the anode of isolation diode 318 in SEGMENT3 then drops by the voltage across SEGMENT2. As discussed in more detail later below, depending on the magnitude of the thresholds and the voltage across the segments, the voltage at the anode of isolation diode 318 may then drop below the first threshold. If the voltage at the anode of isolation diode 318 drops below the first threshold, then bypass switch SW3 will close again. If bypass switch SW3 closes again, then it will open again when the voltage at the anode of isolation diode 318 again increases above the first threshold. Numerical examples of various alternatives for threshold voltages will be given later below.

When the supply voltage increases above a third threshold, bypass switch SW1 opens, and current flows to light emitters 306, 308, and 310 and to capacitor C1. Light emitters 306, 308, and 310 then emit light and capacitor C1 charges. When bypass switch SW1 opens, the voltage at the anode of isolation diode 304 is at the supply voltage $V_{RAC}$ and the voltage at the anode of isolation diode 312 in SEGMENT2 drops by the voltage across SEGMENT1. Bypass switches SW2 and SW3 may then close again. If bypass switch SW3 closes again, then it will open again when the voltage at the anode of isolation diode 318 again increases above the first threshold, and if bypass switch SW2 closes again, then it will open again when the voltage at the anode of isolation diode 312 again increases above the second threshold.

When the bypass switch SW3 opens, current from the supply voltage $V_{RAC}$ flows to the light emitter 320 and to capacitor C3. When the bypass switch SW3 closes again, current flows from the supply voltage $V_{RAC}$ through the bypass switch SW3, bypassing the light emitter 320 and the capacitor C3. When the bypass switch SW3 closes, current from capacitor C3 flows through the light emitter 320 until the bypass switch SW3 opens again. Depending on the size of capacitor C3, it may take multiple half-cycles of the supply voltage $V_{RAC}$ before capacitor C3 is fully charged. Once capacitor C3 is fully charged, light emitter 320 emits light continuously, receiving current from the supply voltage $V_{RAC}$ or capacitor C3, depending on the state of bypass switch SW3. Likewise, once capacitor C2 is charged, light emitters 314 and 316 emit light continuously, receiving current from the supply voltage $V_{RAC}$ or capacitor C2, depending on the state of bypass switch SW2. After all capacitors (C1, C2, C3) have been charged, all light emitters (306, 308, 310, 314, 316, 320) emit light continuously. Accordingly, the lighting system 300 emits light continuously and with almost constant intensity. There is only a very small amount of intensity variation resulting from decreasing voltage on the capacitors (C1, C2, C3) as they discharge. If the peak voltage of the supply voltage $V_{RAC}$ falls below the third threshold but is above the second threshold (for example, during a brown-out or as a result of a dimmer switch), the light emitters in SEGMENT2 and SEGMENT3 will continue to emit light. If the peak voltage of the supply voltage $V_{RAC}$ falls below the second threshold but is above the first threshold, the light emitters in SEGMENT3 will continue to emit light.

Figures 4A, 4B, 4C, 4D:
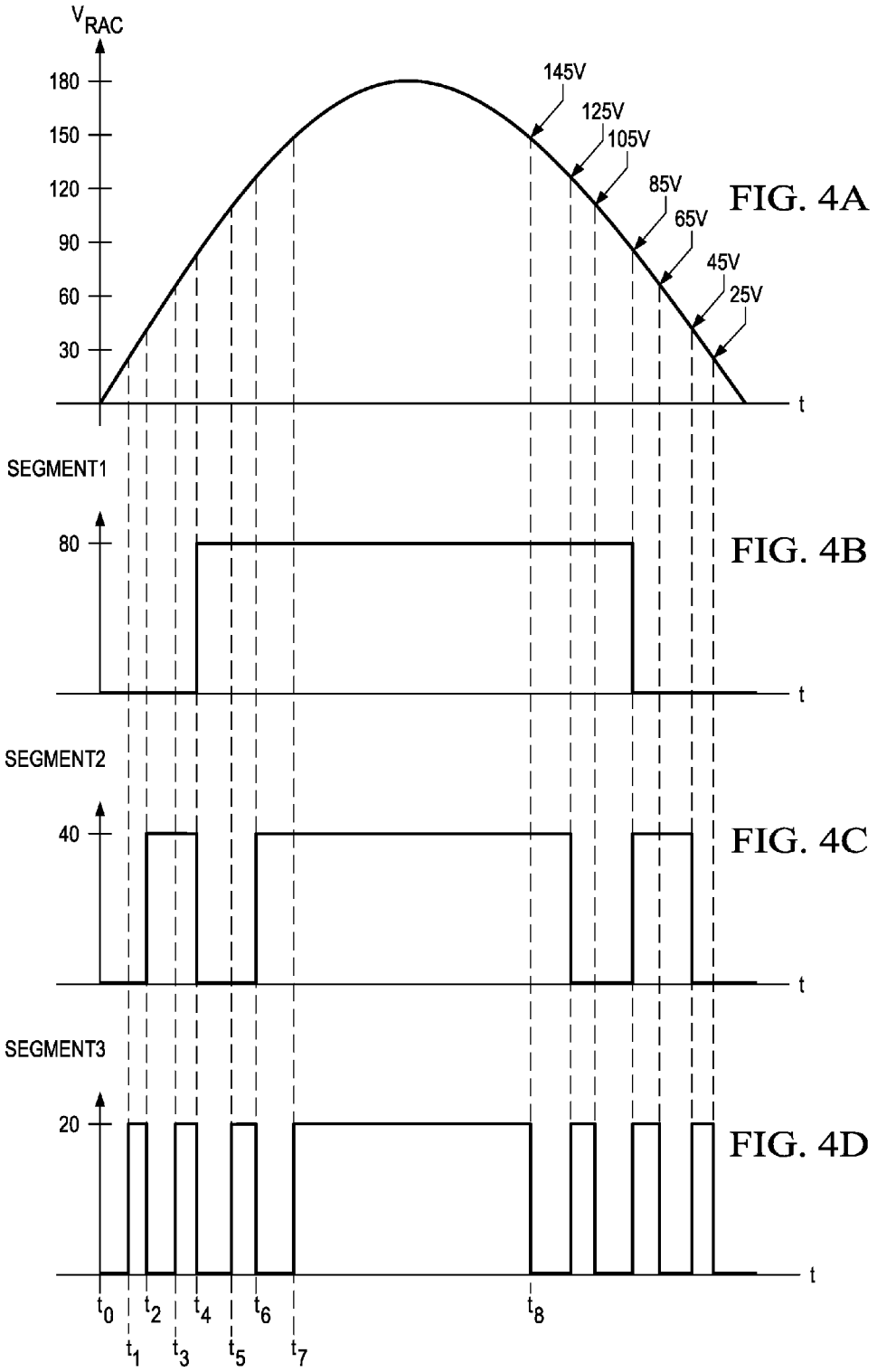
FIGS. 4A-4D are timing diagrams illustrating example timing for the lighting system of FIG. 3.

FIGS. 4A-4D illustrate example timing, example segment voltages, and example thresholds for the lighting system 300 in FIG. 3. In the example of FIGS. 4A-4D, the voltage across SEGMENT3 when bypass switch SW3 is open is assumed to be 20V, the voltage across SEGMENT2 when bypass switch SW2 is open is assumed to be 40V, and the voltage across SEGMENT1 when bypass switch SW1 is open is assumed to be 80V. In the example of FIGS. 4A-4D, the headroom required for the current regulator 302 and switches is assumed to be 5V, the first threshold $V_{T1}$ is assumed to be 25V, the second threshold $V_{T2}$ is assumed to be 45V, and the third threshold $V_{T3}$ is assumed to be 85V. FIG. 4A illustrates the supply voltage $V_{RAC}$. FIG. 4B illustrates the voltage across SEGMENT1. FIG. 4C illustrates the voltage across SEGMENT2. FIG. 4D illustrates the voltage across SEGMENT3.

At time $t_o$, the supply voltage $V_{RAC}$ starts increasing from zero. At time $t_1$, the supply voltage $V_{RAC}$ exceeds the first threshold $V_{T1}$ (25V) and bypass switch SW3 opens. At time $t_2$, the supply voltage $V_{RAC}$ exceeds the second threshold $V_{T2}$ (45V) and bypass switch SW2 opens. When bypass switch SW2 opens at time $t_2$, the voltage across SEGMENT3 drops by the voltage across SEGMENT2 (40V) and bypass switch SW1 closes. At time $t_3$, the supply voltage $V_{RAC}$ exceeds 65V, the controller for bypass switch SW3 again sees 25V relative to ground, and bypass switch SW3 opens again. At time $t_4$, the supply voltage $V_{RAC}$ exceeds the third threshold $V_{T3}$ (85V) and bypass switch SW1 opens. When bypass switch SW1 opens at time t4, the voltage across SEGMENT2 and SEGMENT3 drops by the voltage across SEGMENT1 (80V) and bypass switches SW1 and SW2 close. At time $t_5$, the supply voltage $V_{RAC}$ exceeds 105V, the controller for bypass switch SW3 again sees 25V relative to ground, and bypass switch SW3 opens again. At time $t_6$, the supply voltage $V_{RAC}$ exceeds 125V (note, peak voltage for a $120V_{RMS}$ mains is about 170V), the controller for bypass switch SW2 again sees 45V relative to ground, and bypass switch SW2 opens again. When bypass switch SW2 opens at time $t_6$, the voltage across SEGMENT3 drops by the voltage across SEGMENT2 (40V) and bypass switch SW3 closes again. At time $t_7$, the supply voltage VRAC exceeds 145V, the controller for bypass switch SW3 again sees 25V relative to ground, and bypass switch SW3 opens again. At time $t_8$, the supply voltage $V_{RAC}$ falls below 145V, and the switching sequence described above progresses in the reverse order.

Given the above assumed segment voltages and thresholds, the table below illustrates the states of the bypass switches (SW1, SW2, SW3) as a function of the supply voltage $V_{RAC}$.

TABLE 1

| $V_{RAC}$ | SW1 | SW2 | SW3 |
|---|---|---|---|
| 0-25 | ON | ON | ON |
| 25-45 | ON | ON | OFF |
| 45-65 | ON | OFF | ON |
| 65-85 | ON | OFF | OFF |
| 85-105 | OFF | ON | ON |
| 105-125 | OFF | ON | OFF |
| 125-145 | OFF | OFF | ON |
| >145 | OFF | OFF | OFF |

There are many alternative choices for segment voltages and thresholds. The above assumed thresholds and segment voltages were chosen to improve efficiency, as will be discussed further below. However, each switch transition from open-to-close or close-to-open generates a transient current on the AC mains. Alternatively, the segment voltages and thresholds may be chosen to reduce the number of switch transitions to reduce transient currents on the AC mains. In addition, the thresholds may be adjusted to change the order in which segments turn on and off. The following example illustrates a lighting system with minimal current transients and illustrates adjusting the order in which segments turn on and off. Assume a lighting system as in FIG. 3, but with four segments, with SEGMENT1 closest to the AC mains and SEGMENT4 closest to ground. Assume that $V_{RAC}$ is $230V_{RMS}$. Assume SEGMENT4 has a segment voltage of 40V, and the remaining three segments have segment voltages of 80V. Assume that the threshold for SEGMENT4 is 48V, the threshold for SEGMENT1 is 88V, the threshold for SEGMENT2 is 172V, and the threshold for SEGMENT3 is 256V. Note that the order of the thresholds is different than the order of the segments. The table below illustrates the states of the four bypass switches (SW1, SW2, SW3, SW4) as a function of the supply voltage $V_{RAC}$ for the values assumed above. Note that for the assumed values, only bypass switch SW4 switches ON and OFF multiple times as the supply voltage $V_{RAC}$ increases from zero to a peak voltage. The rest of the switches only switch once, thereby reducing the transient currents on the AC mains.

TABLE 2

| VRAC | SW1 | SW2 | SW3 | SW4 |
|---|---|---|---|---|
| 0-48 V | ON | ON | ON | ON |
| 48 V-88 V | ON | ON | ON | OFF |
| 88 V-128 V | OFF | ON | ON | ON |
| 128 V-172 V | OFF | ON | ON | OFF |
| 172 V-208 V | OFF | OFF | ON | ON |
| 208 V-256 V | OFF | OFF | ON | OFF |
| 256 V-288 V | OFF | OFF | OFF | ON |
| >288 | OFF | OFF | OFF | OFF |

Referring back to Table 1 and FIG. 3, for the assumptions leading to Table 1, the voltage across the current regulator 302 ranges from about 5V to about 25V. For example, when the supply voltage $V_{RAC}$ is slightly below 65V, there is a 40V drop across SEGMENT2 and the voltage across the current regulator 302 is about 25V. When the supply voltage $V_{RAC}$ slightly exceeds 65V, bypass switch SW3 opens, and there is a 20V drop across SEGMENT3 in addition to the 40V drop across SEGMENT2, so the voltage across the current regulator 302 drops to about 5V. Similarly, for the assumptions leading to Table 2, the voltage across the current regulator ranges from about 8V to about 48V for most of the range of the supply voltage $V_{RAC}$. However, because of the 172V threshold for SEGMENT2, the voltage across the current regulator varies from about 8V to about 52V when $V_{RAC}$ is in the range of 128V to 172V, and the voltage across the current regulator varies from about 12V to about 48V when $V_{RAC}$ is the range of 172V to 208V. Therefore, selecting segment voltages and thresholds to reduce transient currents on the AC mains results in a slightly higher average voltage across the current regulator, resulting in a slightly reduced efficiency (there is slightly more heat loss in the current regulator).

Figure 5:
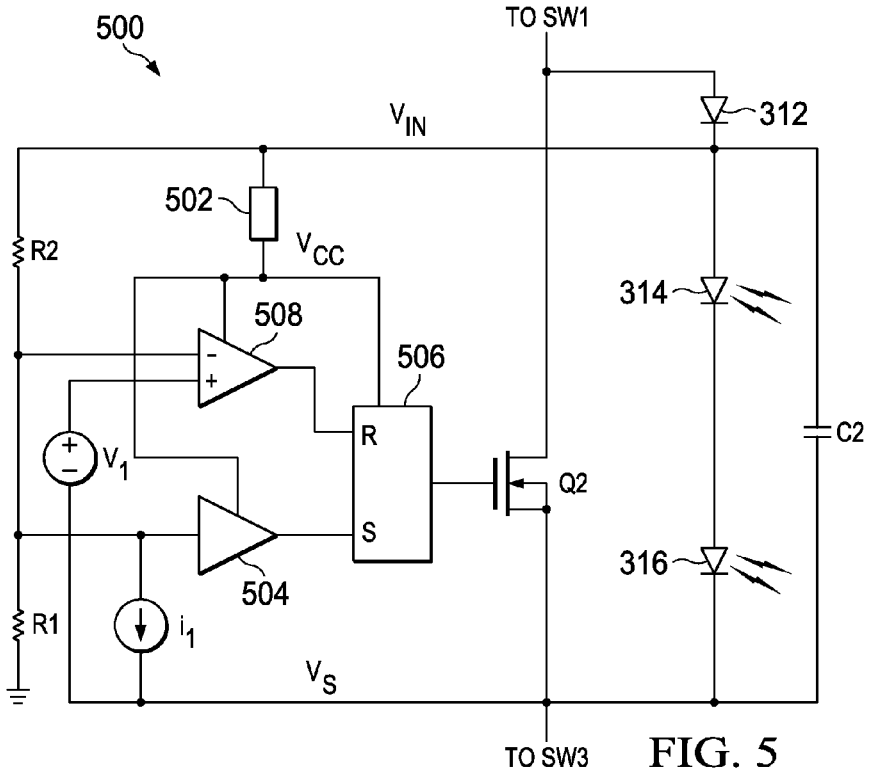
FIG. 5 is a block diagram schematic of a switch controller for the lighting system of FIG. 3.

FIG. 5 illustrates an example embodiment of switch control circuitry 500 for one of the electronic bypass switches (SW1, SW2, SW3) illustrated in FIG. 3. Specifically, FIG. 5 illustrates switch control circuitry for bypass switch SW2 in SEGMENT2. The switch control circuitry 500 in FIG. 5 is simplified to facilitate illustration and discussion. In the example of FIG. 5, the switch control circuitry 500 is driven by the voltage across capacitor C2 ($V_{IN}$–$V_S$). A voltage regulator 502 provides a constant voltage $V_{CC}$ for the electronics. In the example of FIG. 5, bypass switch SW2 is implemented as an MOS transistor Q2. Transistor Q2 is driven by a latch 506. The latch 506 is SET dominant (that is, if both SET and RESET are high, then the latch 506 is SET). The SET input of the latch 506 is driven by an amplifier 504. A current source $i_1$ is connected between the input of the amplifier 504 and $V_S$. A resistor $R_1$ is connected between the input of the amplifier 504 and ground. The RESET input of the latch 506 is driven by an amplifier 508. The resistor R1 is also connected to the negative input of the amplifier 508, and a second resistor R2 is connected between the negative input of the amplifier 508 and $V_{IN}$. A voltage source $V_1$ is connected to the positive input of the amplifier 508. The voltage of the supply voltage $V_{RAC}$ at which the RESET amplifier 508 changes states is slightly below the voltage at which the SET amplifier 504 changes states. This provides hysteresis to prevent the transistor Q2 from being affected by noise on the supply voltage $V_{RAC}$ or ground. As the supply voltage $V_{RAC}$ increases from zero, $V_{IN}$ and $V_S$ increase, and the SET amplifier 504 drives the SET input of the latch 506. As the supply voltage $V_{RAC}$ increases above a RESET threshold, the RESET input of the latch 506 is also driven. Then, when the current through $R_1$ exceeds the current source the SET amplifier 504 no longer drives the SET input of the latch 506, and as soon as the SET input is no longer driven the latch 506 is RESET. As $V_{RAC}$ decreases from the peak voltage, the SET input of the latch 506 is again driven at the higher threshold of amplifier 504. Accordingly, the voltage at which the transistor Q2 switches from ON-to-OFF as the supply voltage $V_{RAC}$ is rising is lower than the voltage at which Q2 switches from OFF-to-ON as the supply voltage $V_{RAC}$ is falling.

Figure 6:
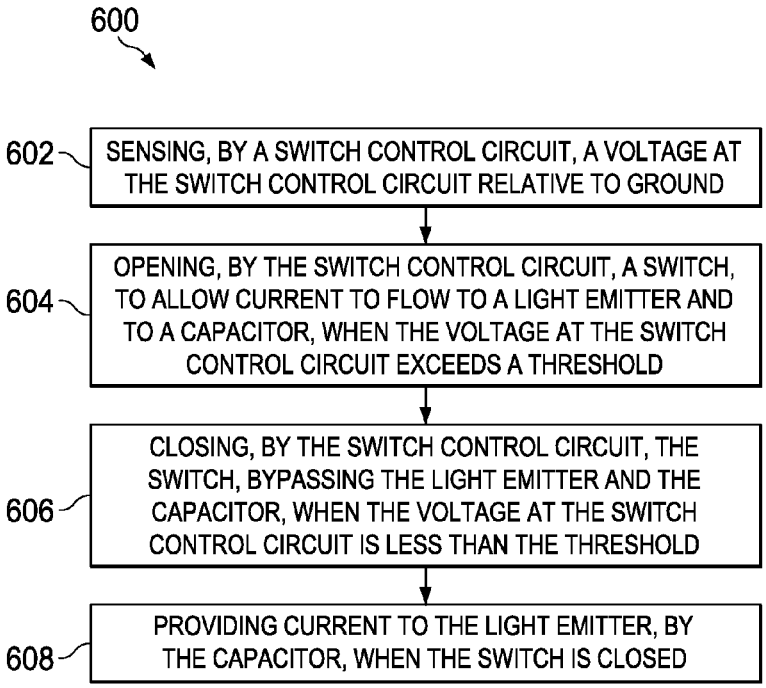
FIG. 6 is a flow chart illustrating an example embodiment of a method.

FIG. 6 illustrates an example method 600. At step 602, a switch control circuit senses a voltage at the switch control circuit. At step 604, when the voltage at the switch control circuit exceeds a threshold, the switch control circuit opens a switch allowing current to flow to a light emitter and to a capacitor. At step 606, when the voltage at the switch control circuit is less than the threshold, the switch control circuit closes the switch, bypassing the light emitter and the capacitor. At step 608, the capacitor provides current to the light emitter when the switch is closed.

In summary, the system of FIGS. 3 and 5 emits light continuously and with almost constant intensity. The system does not require any power source other than the AC mains. The only active circuitry in the current path through the light emitters is a current regulator. The system self-senses when to bypass AC mains current around light emitters and when to allow AC mains current to flow through light emitters. No communications connections are required for the switch controllers (just local voltage sense connections). The system can be adjusted to improve efficiency by reducing the average voltage drop across the current regulator. Alternatively, the system can be adjusted to reduce current transients on the AC mains.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A lighting system, comprising:

a plurality of light emitters arranged into a plurality of segments, the segments connected in series between a rectified alternating current (AC) power mains and ground;

each segment including a capacitor connected in parallel with at least one light emitter in the segment;

each segment including an electronic bypass switch that allows current to flow from the power mains through the light emitters in the segment and to the capacitor in the segment when the bypass switch is in a first state, and current from the power mains bypasses the light emitters and the capacitor in the segment when the bypass switch is in a second state; and current to the light emitters in each segment is provided by the capacitor in the segment when the bypass switch is in the second state;

further comprising:

a plurality of timing control circuits, one timing control circuit for each of the plurality of light emitter segments for generating timing signals for the electronic bypass switch of one segment independent of timing control signals for the bypass switch of other light emitter segments without central control, comprising:

a logic circuit having to output states having an output coupled to the electronic bypass switch wherein a first state drives the electronic switch OFF and a second state drives electronic bypass switch ON;

a circuit for determining a voltage across the segment for driving the logic circuit to the first state when the voltage across the segment exceeds a first threshold and for driving the logic circuit to the second state when the voltage across the segment drops below a second threshold, wherein as the rectified AC power rises and falls, the electronic bypass switches of different ones of the plurality of timing control circuits turn ON and OFF as the voltage across the segments change due to the insertion or removal, by the action of the electronic bypass switches, of the series connected light emitter segments.

2. The lighting system of claim 1, the switch control sensing a voltage at the switch controller relative to ground, the switch controller controlling the switch to be in the first state when the voltage at the switch controller exceeds the predetermined threshold.

3. The lighting system of claim 1 where the light emitters are Light Emitting Diodes.

4. The lighting system of claim 1, each segment further comprising a diode connected so that the capacitor in the segment does not discharge through the bypass switch when the bypass switch is in the second state.

5. The lighting system of claim 1, the switch controlled to be in the first state a plurality of times as the rectified power mains increases from zero to a peak voltage.

6. The lighting system of claim 1, the switch controller comprising an amplifier having an input, and a resistor coupled between the input and ground, so that when current through the resistor exceeds a predetermined threshold the amplifier causes the bypass switch to be in the first state.

7. The lighting system of claim 1 wherein after an initialization period, all of the light emitters continuously emit light.

8. A method of operating a lighting system, comprising:

sensing, by a switch control circuit for each of a plurality of light emitter segments, a rectified AC voltage at the switch control circuit relative to ground;

opening, by the switch control circuit, a switch, to allow current to flow to one light emitter segment and to a capacitor, when the voltage at the switch control circuit exceeds a threshold;

closing, by the switch control circuit, the switch, bypassing the one light emitter segment and the capacitor, when the voltage at the switch control circuit is less than the threshold; and providing current to the light emitter, by the capacitor, when the switch is closed, wherein as the rectified AC power rises and falls, the electronic bypass switches of different ones of the plurality of timing control circuits turn ON and OFF as the voltage across the segments change due to the insertion or removal, by the action of the electronic bypass switches, of the series connected light emitter segments.

9. The method of claim 8, further comprising:

preventing, by a diode, current from the capacitor from flowing through the switch when the switch is closed.

10. The method of claim 8, further comprising:

closing, by the switch control circuit, the switch, a plurality of times as a supply voltage increases from zero to a peak voltage.

* * * * *